United States Patent [19]

King

[11] 4,084,717

[45] Apr. 18, 1978

[54] CONTAINER AND CLOSURE

[75] Inventor: Roderick V. King, Girard, Pa.

[73] Assignee: VCA Corporation, Baton Rouge, La.

[21] Appl. No.: 811,325

[22] Filed: Jun. 29, 1977

[51] Int. Cl.[2] ..... B65D 55/02; B65D 85/56

[52] U.S. Cl. ..... 215/217; 215/31

[58] Field of Search ..... 215/31, 216, 217, 220, 215/223

[56] References Cited

U.S. PATENT DOCUMENTS

| | | | |
|---|---|---|---|
| 3,979,001 | 9/1976 | Bogert | 215/217 |
| 4,032,028 | 6/1977 | Reiss et al. | 215/217 |

*Primary Examiner*—George T. Hall

*Attorney, Agent, or Firm*—Donald L. Johnson; John F. Sieberth; Edgar E. Spielman, Jr.

[57] ABSTRACT

A child-resistant container and closure is disclosed. The container has multiple helical threads with each thread having a ratchet portion at its start end. The closure features a like number of helical threads for cooperation with the container threads. The closure threads have adjacent their terminal ends at least one ratchet tooth for cooperation with the ratchet portion of the closure threads. Means is also provided for disengaging the ratchet teeth with the ratchet portion by providing for downward axial movement of the closure.

14 Claims, 9 Drawing Figures

CONTAINER AND CLOSURE

BACKGROUND OF THE INVENTION

Many child-resistant caps and closures have been suggested in recent years because of the greater activity directed towards insuring that dangerous and poisonous materials be packaged in containers which are significantly difficult for small children to open.

Exemplary of the containers and closures developed by the art in response to this need is the closure and container shown in U.S. Pat. No. 3,888,376. This container and closure is in the class of child-resistant packages which feature latching and unlatching means carried by the threads of the closure and the container. Generally, this class is beset by the problem of requiring very exact container and closure manufacture so that registration of the latching structure can be predictably effected. The manufacturing standards required are oftentimes difficult to achieve when it is considered that the packager oftentimes purchases the containers from sources separate from the closures.

Despite these difficulties, however, this class of child-resistant closure and container is highly desirable in that the locking mechanism is carried internal to the package when the closure is fitted to the container. Other classes of child-resistant closures and containers which rely upon exterior locking systems oftentimes are not entirely satisfactory as a child is free to attack the locking structure.

Therefore it is an object of this invention to provide a container and closure which is child-resistant, which is in the class of containers and closures which have the locking systems carried by the threads of the containers and closures, and which is able to achieve its child-resistant locking position even when manufacturing tolerances are kept far below precise levels.

THE INVENTION

This invention relates to a container and closure in which the container comprises: (1) a body portion, (2) a cylindrical neck portion, and (3) a plurality of helical container threads equiangularly spaced about the outside circumference of the neck, the container threads having a ratchet portion at their start end. The closure comprises: (1) a top wall; (2) an annular sidewall, downwardly depending from the top wall; (3) a plurality of helical closure threads equiangularly spaced about the inside circumference of the sidewall for cooperating with the container threads to achieve tight fitment of the closure on the container, the closure threads being of the same number as the container threads; (4) at least one inwardly projecting ratchet tooth separate from the closure thread and adjacent the terminal end of each closure thread for engagement with the ratchet portion of the container thread to prevent removal of the closure from the container while the engagement is maintained; and (5) flex means for permitting axial movement of the closure to achieve disengagement of the ratchet tooth from the ratchet portion.

As will be seen from the following description of an embodiment of the invention, the ratchet portion can traverse, for example, 20° of arc. Since the ratchet portion is rather extensive in length, the closure can be screwed onto the container and the anti-rotational lock obtained with the closure being in many different positions within the 20° spanned by the ratchet portion.

Thus there is great leeway for design flaws and different tightening torques as required by different industries.

Another advantage of the container and closure of this invention is that there is a substantially equal pressure applied to the closure liner as the closure is tightened onto the container. Achieving this equal distribution of tightening pressure on the line is accomplished by the utilization of the multiple helical threads.

These and other features contributing to satisfaction in use and economy in manufacture will be more fully understood from the following description of a preferred embodiment of the invention when taken in connection with the accompanying drawings wherein identical numerals refer to identical parts and in which.

Figure 1:
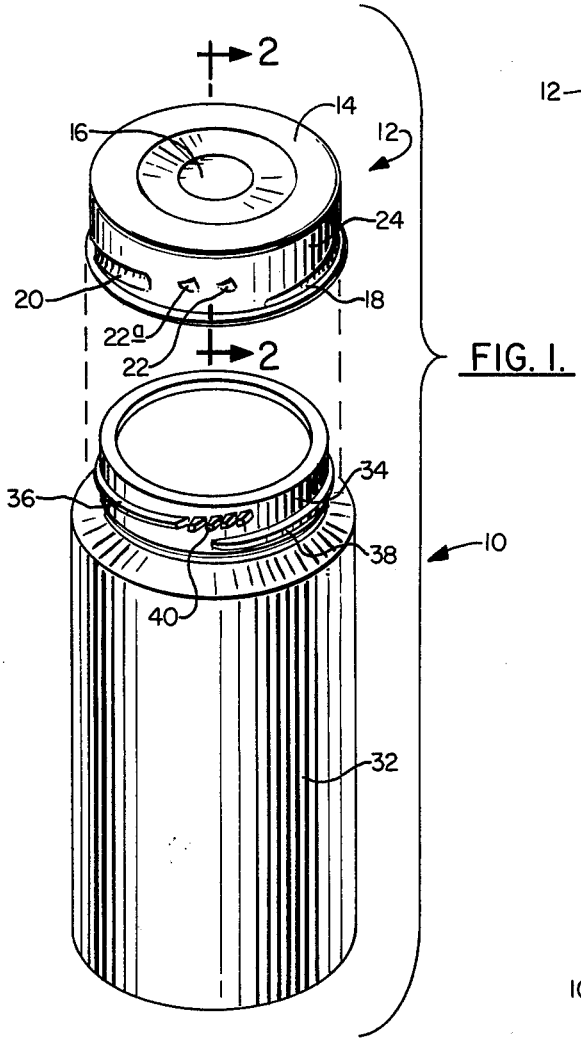
FIG. 1 is a perspective view of a container and closure of this invention.

Referring now to FIGS. 1, 3–6 and 9, there can be seen a closure of this invention, generally designated by the numeral 12, and a container of this invention, generally designated by the numeral 10.

The container 10 has a cylindrical body portion 32 and a cylindrical neck portion 34. Body portion 32 need not be cylindrical but rather can be of any configuration which is suitable for the particular packaging requirement of the packager. Equiangularly spaced about the outside circumference of neck portion 34 are container threads 36 and 38. In the embodiment shown, only two container threads are used. It is to be understood, however, that more threads may be utilized as long as they are equiangularly spaced about the neck circumference. Utilization of more than two threads will occur in those instances where the container necks are quite large, i.e., necks having a diameter from about 1½ to about 2½ inches. When two container threads are utilized it has been found that the container thread with their ratchet portions should traverse an arc from about 90° to about 150°.

At the start ends of container threads 36 and 38 are ratchet portions 40 and 42. When utilizing two container threads it has been found useful for ratchet portions 40 and 42 to traverse an arc from about 15° to about 30°. With this amount of traverse ratchet portions 40 and 42 will allow for ample multiple position engagement with ratchet teeth carried by closure 12 as hereinafter described.

Ratchet portions 40 and 42 are made up of a plurality of teeth. Each tooth has a flat wall and a sloped wall. Direction of the sloped wall for the ratchet portions will be in a direction which is clockwise.

Closure 12 has a top wall 14 and an annularly downwardly depending sidewall 24. About the inside circumference of sidewall 24 are helical closure threads 18 and 20. The number of closure threads will be the same number as that provided on the container. It should be noted that closure threads 18 and 20 are preferably shorter in length than container threads 36 and 38. The difference in length is desired to prevent the closure threads from interfering with the ratchet portion of the container and the ratchet teeth carried by the closure in those instances where interference may be encountered. However, the closure thread length should not be shorter than that required to provide a tight fitment of the closure onto the container. For example, it has been found preferable that when the two container threads each traverse an arc of from about 60° to about 135°, the two closure threads should traverse an arc of from about 30° to about 60° with these latter threads being shorter.

Ratchet teeth 22 and **22*a* are spaced adjacent to closure thread 20 while ratchet teeth 26 and 26*a* are spaced adjacent to closure thread 18. As can be seen from FIGS. 1–3, ratchet teeth 22 and 22*a* and 26 and 26*a* are positioned adjacent their respective closure threads so that they are positioned along the helical path formed by their respective threads. It is important to note that ratchet teeth 22, 22*a*, 26 and 26*a* not only continue the helical path but also are located slightly upward the helical plane for the respective closure threads. This upward and adjacent position is important for it insures that the ratchet teeth will engage ratchet portions 40 and 42**.

In the embodiment shown in the drawings two ratchet teeth are utilized. This is a preferred number as two teeth insure better locking than a single tooth. The ratchet teeth are formed so that each set has a flat wall and a sloped wall. The sloped walls are in a counterclockwise direction when the closure is screwed onto the container. The ratchet teeth flat walls engage and abut in locking fashion the flat walls of the ratchet portion of the container threads to prevent unscrewing the closure from the container as long as the engagement is maintained.

Figure 2:
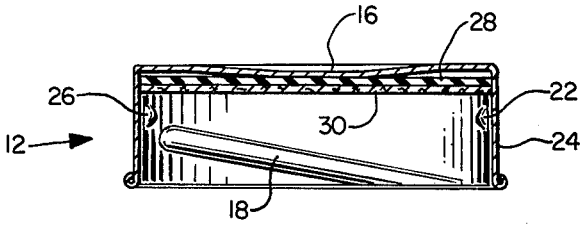
FIG. 2 is a sectional view taken through section lines 2—2 of FIG. 1.
Figure 3:
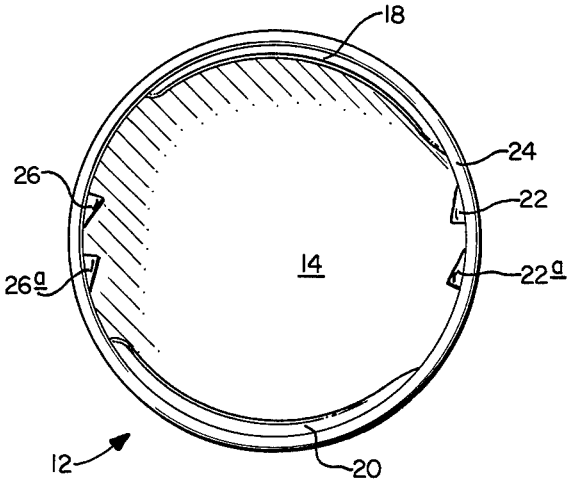
FIG. 3 is a bottom plan view of the closure shown in FIG. 1.
Figure 6:
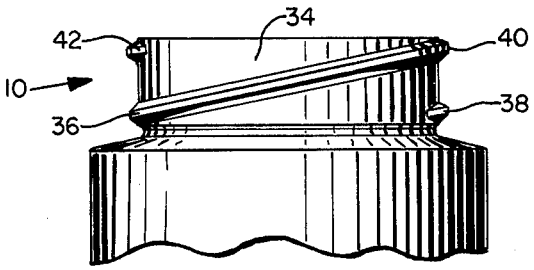
FIG. 6 is a partial left side elevational view of the container shown in FIG. 1.
Figure 4:
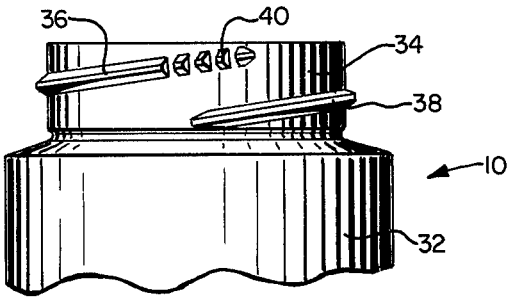
FIG. 4 is a partial front elevational view taken of the container shown in FIG. 1.
Figure 5:
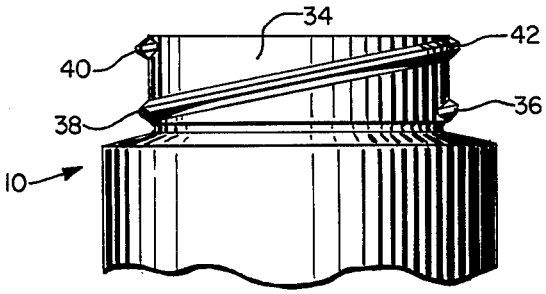
FIG. 5 is a partial right side elevational view of the container shown in FIG. 1.
Figure 9:
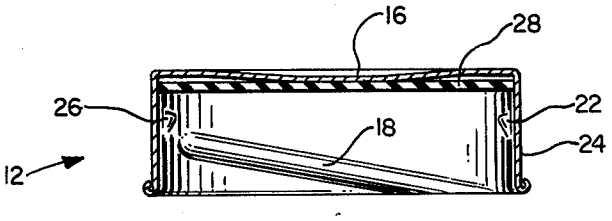
FIG. 9 is a sectional view taken through the center of another closure of this invention.

As mentioned previously, ratchet portions 40 and 42 cooperate with ratchet teeth 22, **22*a*, 26 and 26*a* respectively, to lock closure 12 onto container 10. Unlocking is achieved by moving the teeth from disengagement with the ratchet portion. Preferably disengagement can be accomplished by moving the teeth in a downward direction from the ratchet portion until disengagement is achieved. As soon as disengagement is achieved rotation of the closure in the opening direction will remove the ratchet teeth from the vicinity of the ratchet portion to thereby prevent further locking. To provide this displacement of the ratchet teeth from the ratchet portion, closure 12, in the embodiment shown, is provided with an inwardly extending dimple 16. This inwardly projecting dimple is slightly flexible so that when an axial downward force is applied to closure 12, dimple 16 will flex upwardly allowing the ratchet teeth to achieve downward displacement. To achieve correct action when utilizing dimple 16, there should be provided a rigid seal, such as rigid seal 28 as shown in FIGS. 2 and 3, against which dimple 16** may act.

As can be appreciated, there are many other systems which may be utilized to achieve axial movement of closure 12 other than the dimple-seal arrangement discussed above. For example, a very viable system would be one in which closure 12 has an inwardly projecting non-flexible dimple which acts against a resilient disk which fits within closure 12 and which abuts the inside surface of the closure top wall. Pushing downward on this type of closure would result in deflection of the resilient disk thereby allowing the closure to move axially upwardly and downwardly. When utilizing a resilient disk it will be desirable to have a sealing disk 30 (in FIG. 2) sandwiching the resilient disk against the inside of the top wall of the closure. As can be appreciated, the sealing disk will act to prevent leakage of the contents from the container when the closure is fitted thereon.

Figure 7:
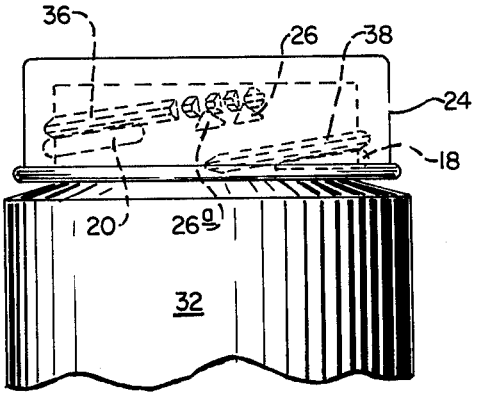
FIG. 7 is a partial front elevational view of the container and closure shown in FIG. 1 with the closure in the locking position.
Figure 8:
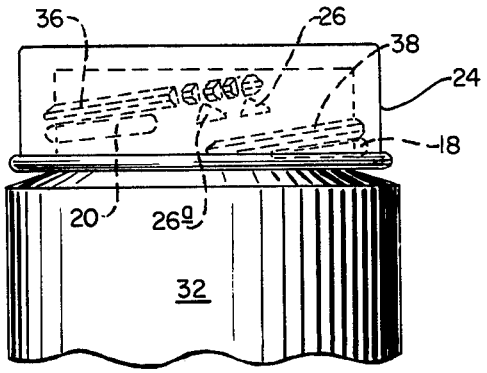
FIG. 8 is a partial front elevational view of the container and closure shown in FIG. 1 with the closure in the release position.

In FIGS. 7 and 8 there is shown container 10 and closure 12 in the locked and unlocked positions, respectively. In FIG. 7 closure 12 is locked to container 10. This locking is achieved by simply placing closure 12 onto the neck of container 10 and rotating closure 12 in the clockwise direction. Once rotation is sufficient so that ratchet teeth 22 and **22*a*, 26 and 26*a* engage ratchet portions 40 and 42, counterclockwise rotation of closure 12 will be impossible. Note the amount of tolerance provided by ratchet portions 40 and 42**. As can be seen, the positioning of the ratchet teeth need not be exact and that considerable leeway is given for obtainment of engagement between the ratchet teeth and the ratchet portions.

In FIG. 8 there is depicted the unlocking of closure 12 from container 10 by the simple mode of pushing downward on closure 12 until the ratchet teeth are displaced downwardly from ratchet portions 40 and 42. At this time, while maintaining this downward pressure, the user of the container and closure of this invention can achieve removal of closure 12 from container 10 by merely rotating the closure in the counter-clockwise direction. The downward force may be removed once the ratchet teeth have left the vicinity of ratchet portions 40 and 42.

The closure of this invention is preferably made of metal. Metals such as mild steel, aluminum, etc., are suitable. The container may be made of either plastic, glass or metal. When utilizing plastic, it is preferable to utilize a plastic such as high impact polystyrene which will not be destroyed by the ratchet teeth carried by the closure.

What is claimed is:

1. A container and closure, wherein said container comprises:

a body portion;

a cylindrical neck portion; and a plurality of helical container threads equiangularly spaced about the outside circumference of said neck, said container threads having a ratchet portion at their start ends;

and wherein said closure comprises:

a top wall;

an annular sidewall, downwardly depending from said top wall;

a plurality of helical closure threads equiangularly spaced about the inside circumference of said sidewall for cooperating with said container threads to achieve tight fitment of said closure on said container, said closure threads being of the same number as said container threads;

at least one inwardly projecting ratchet tooth separate from each closure thread and adjacent the terminal end of each closure thread for engagement with the ratchet portion of said container thread to prevent removal of said closure from said container while said engagement is maintained; and flex means for permitting axial movement of said closure to achieve disengagement of said ratchet tooth from said ratchet portion.

2. The container and closure of claim 1 wherein said closure threads are shorter in length than said container threads.

3. The container and closure of claim 1 wherein there are two helical container threads.

4. The container and closure of claim 2 wherein said container threads traverse an arc from about 60° to about 135° and said closure threads traverse an arc from about 30° to about 60° with the latter threads being shorter.

5. The container and closure of claim 1 wherein said closure is provided with two ratchet teeth for each of said closure threads.

6. The container and closure of claim 1 wherein said flex means is provided by a flexible inwardly projecting dimple in the top wall of said closure which dimple contacts a rigid disk positioned within said closure.

7. The container and closure of claim 1 wherein said flex means comprises a resilient disk fitting within said closure and abutting the inside surface of said top wall and said top wall has a lowered portion abutting said disk.

8. The container and closure of claim 1 wherein said closure additionally has within its interior a sealing disk which disk sandwiches said resilient disk between itself and said inside surface of said top wall.

9. The container and closure of claim 1 wherein there are two helical container threads, said container threads traversing an arc from about 60° to about 135° and each of said ratchet portions traversing an arc of from about 15° to about 30°.

10. The container and closure of claim 9 wherein said closure is provided with two ratchet teeth for each of said closure threads.

11. The container of claim 10 wherein said closure threads traverse an arc from about 30° to about 60°.

12. The container and closure of claim 11 wherein said flex means is provided by a flexible inwardly projecting dimple in the top wall of said closure, which dimple contacts a rigid seal positioned within said closure.

13. A closure for fitment to a container, which container has a plurality of helical container threads equiangularly spaced about the outside circumference of its cylindrical neck portion and which container threads have a ratchet portion at their start end, said closure comprising:

a top wall;

an annular sidewall, downwardly depending from said top wall;

a plurality of helical closure threads equiangularly spaced about the inside circumference of said sidewall, for cooperating with said container threads to achieve tight fitment of said closure on said container, said closure threads being of the same number as said container threads;

at least one inwardly projecting ratchet tooth separate from each closure thread and adjacent the terminal end of each closure thread for engagement with the ratchet portion of said container thread to prevent removal of said closure from said container while said engagement is maintained; and flex means for permitting axial movement of said closure to achieve disengagement of said ratchet tooth from said ratchet portion.

14. A container for fitment to a closure wherein said container comprises:

a body portion;

a cylindrical neck portion; and a plurality of helical container threads equiangularly spaced about the outside circumference of said neck, said container threads having a ratchet portion at their start end; and wherein said helical container threads cooperate with helical threads on said closure to achieve tight fitment of said container to said closure and wherein said ratchet portion of said container threads cooperate with ratchet teeth carried by said closure to prevent removal of said closure from said container while said engagement is maintained.

* * * * *